US007452310B2

(12) United States Patent
Wang

(10) Patent No.: US 7,452,310 B2
(45) Date of Patent: Nov. 18, 2008

(54) LEISURE FITNESS EQUIPMENT WITH OXYGEN-SUPPLYING FUNCTION

(76) Inventor: Dong-lei Wang, No. 1 Jinfeng Road, Tangjiawan Town, Xiangzhou District. Zuhai City, Guangdong Province (CN)

( * ) Notice: Subject to any disclaimer, the term of this patent is extended or adjusted under 35 U.S.C. 154(b) by 0 days.

(21) Appl. No.: 11/424,247

(22) Filed: Jun. 15, 2006

(65) Prior Publication Data

US 2007/0023041 A1 Feb. 1, 2007

(30) Foreign Application Priority Data

Jun. 22, 2005 (CN) ..... 2005 2 0060531 U

(51) Int. Cl.
*A63B 71/00* (2006.01)

(52) U.S. Cl. ..... 482/54; 128/202.12; 482/1; 482/8

(58) Field of Classification Search ..... 128/202.12; 482/1–9, 900–902, 54; 600/323
See application file for complete search history.

(56) References Cited

U.S. PATENT DOCUMENTS 4,441,502 A * 4/1984 Chance ..... 600/411
4,724,845 A * 2/1988 Callahan ..... 600/531
4,854,327 A * 8/1989 Kunig ..... 600/526
5,025,795 A * 6/1991 Kunig ..... 600/526
5,571,075 A * 11/1996 Bullard ..... 601/152
5,850,833 A * 12/1998 Kotliar ..... 128/202.12
6,131,569 A * 10/2000 Schuster ..... 128/200.24
6,890,316 B2 * 5/2005 Rawles et al. ..... 604/6.16
2002/0123679 A1 * 9/2002 Dominguez ..... 600/382
2006/0217603 A1 * 9/2006 Nagai et al. ..... 600/323

* cited by examiner

*Primary Examiner*—Glenn Richman
(74) *Attorney, Agent, or Firm*—Allen, Dyer, Doppelt, Milbrath & Gilchrist, P.A.

(57) ABSTRACT

The present invention provides a leisure fitness equipment with oxygen-supplying function, comprising a leisure fitness device, an oxygenerator and a control device, said oxygenerator is fixed or detachably connected to said leisure fitness device, said leisure fitness device and said oxygenerator are controllable by said control device. The present invention has a compact structure, have a function of oxygen-supplying in addition to leisure or fitness, and it is suitable for family use and for public places such as entertainment sites, physical training centers or hospitals.

8 Claims, 5 Drawing Sheets

LEISURE FITNESS EQUIPMENT WITH OXYGEN-SUPPLYING FUNCTION

CROSS-REFERENCE TO RELATED APPLICATION

This application claims priority of CN Patent Application No. 200520060531.6 filed on Jun. 22, 2005, entitled "Leisure Fitness Equipment with Oxygen-supplying Function", which is incorporated herein by reference for all purposes.

TECHNICAL FIELD

The present invention relates to leisure fitness equipment, and more particularly, to leisure fitness equipment with oxygen-supplying function.

BACKGROUND ART

When working, traveling or resting, people may desire to release fatigue by massage, or to exercise body by using a running machine, a fitness bicycle or a skiing machine. But for lots of people who have respiratory diseases or cardio-cerebro vascular diseases, for pregnant women and for old people, there exist problems of oxygen shortage for human body under tiring labor or brainwork, or strenuous exercises. When lying in a comfortable massage sofa or doing strenuous exercises with a running machine, a fitness bicycle or a skiing machine, people would prefer to have an oxygen-supplying device so as to solve the problem of oxygen shortage. If there exists a device with oxygen-supplying function in addition to leisure or fitness in family houses, entertainment or working sites, it will be more convenient and more effectively for people to get medical treatment, body building and health care. But in the prior art, leisure fitness device, such as a massage sofa, a running machine, a fitness bicycle, a skiing machine, is separated from an oxygenerator, and generally, an oxygenerator has a large volume and heavy weight which is not satisfactory for people; moreover, the cost is rather high to use both of the two kinds of devices and it is not convenient to operate the two in combination.

SUMMARY OF THE INVENTION

The object of the present invention is to solve the problem of oxygen shortage when people are using leisure or fitness device of prior art, so as to provide a leisure fitness equipment which includes an oxygenerator and is able to supply enough oxygen for users while they are resting or exercising. The present invention has compact structure and low cost.

The technical scheme of the present invention is as follows:

A leisure fitness equipment with oxygen-supplying function, comprising:

a leisure fitness device, an oxygenerator, which is fixed or detachably connected to said leisure fitness device, a control device, by which said leisure fitness device and said oxygenerator are controllable, an oxygen inhalator having two ends, one end of said oxygen inhalator is accessible for users, an automatic disengaging means having two ends, one end of said automatic disengaging means is fixed on the top of said leisure fitness device and connected to said oxygenerator, the other end of said automatic disengaging means is detachably connected to said oxygen inhalator.

The leisure fitness device is any one kind of a massage sofa, a running machine, a fitness bicycle or a skiing machine.

The oxygenerator is fixed or detachably connected to the base frame of the leisure fitness device.

The oxygenerator is either a micro membrane oxygen-enriched machine or a micro PSA oxygenerator.

The control device is in the form of either a controller or a control panel.

A flow control device is installed on the oxygen inhalator.

The end of the oxygen inhalator, which is accessible for users, is connected with an oxygen mask.

The automatic disengaging means comprises a joint, a release spring and a positioning device; wherein one end of the joint is connected to the oxygen inhalator the other end is set inside a base on the top of the leisure fitness device and presses against the release spring set inside the base; and wherein the joint is positioned inside the base via the positioning device and can be released from the base.

The automatic disengaging means is set with a gravity limit or tension limit, such that, once a user using said inhalator falls down, the automatic disengaging means will release and cause said oxygen inhalator to automatically release from the user.

The present invention has advantages as follows:

A user can control the working state of both the leisure fitness device and the micro-oxygenerator at the same time by operating the control device of the leisure fitness equipment. The oxygen inhalator or the oxygen mask is set on the front of the user, which blow head-on oxygen for the user who is exercising, and the oxygen concentration can be adjusted by adjusting the flow control valve on the oxygen inhalator, so as to solve the problem of oxygen shortage. Furthermore, oxygen generated can be supplied to the user via an oxygen inhalator. Once a user using said oxygen inhalator or wearing said oxygen mask falls down, said automatic disengaging means will release and cause said oxygen inhalator to automatically release from the user. In the present invention, a micro-oxygenerator is incorporated with a leisure fitness device such as a massage sofa, a running machine, a fitness bicycle or a skiing machine, therefore, the present invention has a compact structure, have a function of oxygen-supplying in addition to leisure or fitness, and it is suitable for family use and for public places such as entertainment sites, physical training centers or hospitals.

BRIEF DESCRIPTION OF THE DRAWINGS

FIG. 1(*b*) is an enlarged view of the automatic disengaging means of the leisure fitness equipment shown in FIG. 1(*a*);

FIG. 1(*c*) is a schematic view showing the embodiment 2 of the leisure fitness equipment with oxygen-supplying function of the present invention, wherein the leisure fitness device is a running machine, the oxygenerator is a micro membrane oxygen-enriched machine;

FIG. 2(*b*) is a schematic view showing the embodiment 4 of the leisure fitness equipment with oxygen-supplying function of the present invention, wherein the leisure fitness device is a massage sofa, the oxygenerator is a micro membrane oxygen-enriched machine;

DETAILED DESCRIPTION OF THE PREFERRED EMBODIMENTS

The present invention will now be described in details with reference to the companying drawings and embodiments, in which same references refer to similar parts.

Embodiment 1

Figure 1A:
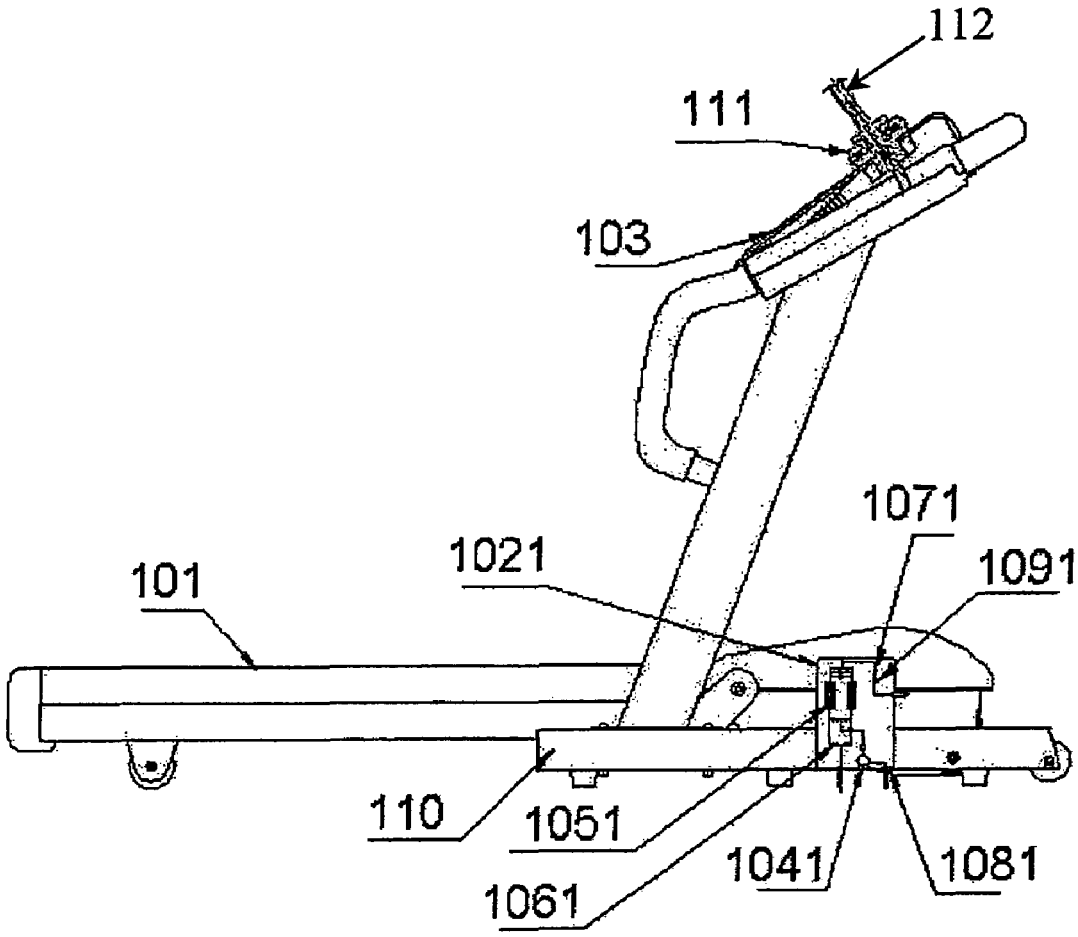
FIG. 1(*a*) is a schematic view showing the embodiment 1 of the leisure fitness equipment with oxygen-supplying function of the present invention, wherein the leisure fitness device is a running machine, the oxygenerator is a micro PSA oxygenerator.
Figure 1B:
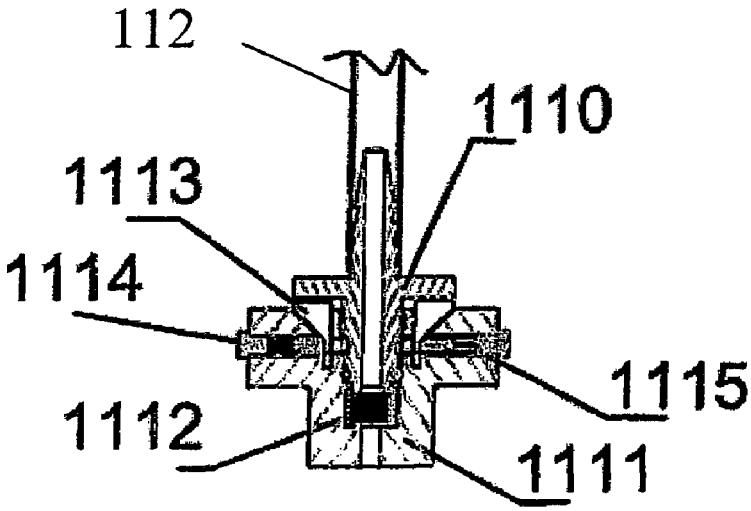
Figure 1C:
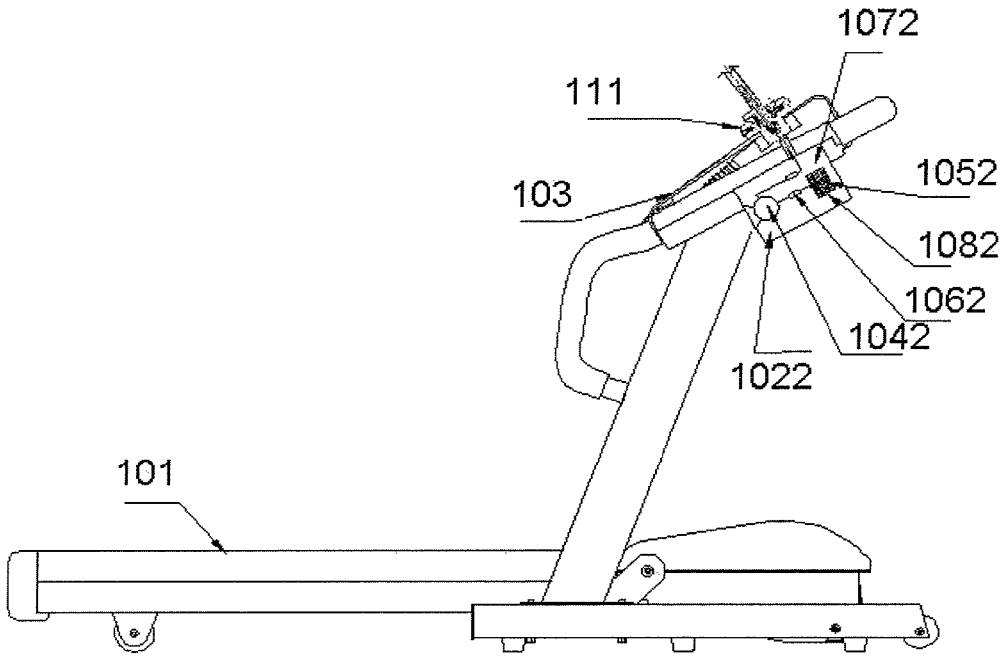

As shown in FIG. 1(*a*), a leisure fitness equipment with oxygen-supplying function comprises a running machine101, an oxygenerator, a control device 103, an oxygen-supplying pipe, an automatic disengaging means 111, an oxygen inhalator 112 and an oxygen mask.

The oxygenerator is a micro PSA oxygenerator 1021, which is set on the base frame 110 of the running machine101 and integral with the running machine101. The micro PSA oxygenerator 1021 comprises a micro oil free air-boost compressor 1041, two micro zeolite molecular sieve adsorption towers 1051, a control valve1061, a buffer tank 1071, an air filter 1081 and a flow control valve 1091. The oxygen-supplying pipe is connected between the outlet of the oxygenerator and the automatic disengaging means 111. Air is taken into the micro oil free air-boost compressor1041 through the air filter 1081, enters into the two zeolite molecular sieve adsorption towers 1051 via the control valve 1061 in an alternately manner, then passes through the buffer tank 1071, the flow control valve 1091, the oxygen-supplying pipe, the automatic disengaging means 111, and finally is supplied for exercising people via the oxygen inhalator 112 or oxygen mask. In which, the micro zeolite molecular sieve adsorption tower 1051 is a pressure swing adsorption (PSA) zeolite molecular sieve, which can produce oxygen in accordance with the medical standard. Thereby, the micro PSA oxygenerator 1021 can provide enough oxygen and improve the oxygen concentration for oxygen shortage places, such as sites installed with a massage sofa, a running machine, a fitness bicycle or a skiing machine; alternatively, oxygen produced may be directly supplied to users via an oxygen inhalator 112.

The leisure fitness equipment further comprises an oxygen inhalator 112 having two ends, wherein one end is connected to an end of the automatic disengaging means 111, and the other end is accessible for users. The end of said oxygen inhalator 112, which is accessible for users, can be further connected to an oxygen mask. The oxygenerator 1021 is directly connected to or is indirectly, via a changeover valve, connected to an end of the oxygen-supplying pipe.

A mechanical or an electrical automatic disengaging means 111 having two ends is set on the top of the running machine 101, one end of which is fixed on the control panel 103 and connected with the other end of the oxygen-supplying pipe, the other end of the automatic disengaging means 111 is detachably connected to the oxygen inhalator 112. When a user inhales oxygen with an oxygen inhalator 112 or an oxygen mask, once the user falls down, to whatever directions, due to the preset gravity limit or tension limit, the oxygen inhalator 112 will be released from the user automatically.

The automatic disengaging means 111 is shown in details in FIG. 1(*b*), wherein one end of the joint 1110 is connected to the oxygen inhalator 112, the other end is set inside a base on the control panel 103 and presses against a release spring 1112 set on the bottom of the base 1111, so as to keep the release spring 1112 in a compressed state and generate a preset pressure limit. In order to position the joint 1110 inside the base 1111 and make sure the joint 1110 can be released from the base 1111 once the user is falling down, a positioning device is adopted which is constructed of a wedge 1113, a positioning pin 1114 and a return spring 1115, meanwhile a groove is set on the joint 1110 where the joint 1110 contacts with the positioning pin 1114. In normal use, by the return spring 1115, the positioning pin 1114 is pressed tightly in the groove of the joint 1110, and the joint 1110 is fixed inside the base 1111. Once the user falls down, the oxygen inhalator 112 generates an upward force, in addition, due to the counter-force by the release spring 1112, the joint 1110 is forced to move upwardly from the bottom of the base 1111, which pushes the positioning pin 1114 to move outwardly with the aid of the return spring 1115. Once the positioning pin 1114 is released from the groove, the joint 1110 is released from the base 1111, thereby the oxygen inhalator 112 is released from the user.

The control device 103 is in the form of a control panel setting on the top of the running machine, for controlling and setting the working state of the running machine 101 and the micro-oxygenerator 1021.

Embodiment 2

As shown in FIG. 1(*c*), the difference between the present embodiment and the embodiment 1 is that, the oxygenerator is a micro membrane oxygen-enriched machine 1022, and set at the underside of the control panel 103 on the top of the running machine 101. Said micro membrane oxygen-enriched machine 1022 comprises a micro oil free vacuum pump 1042, a membrane assembly 1052, a buffer tank 1062, a condensed water tank 1072, and a fan 1082. The oxygen-supplying pipe is connected between the outlet of the oxygenerator and the automatic disengaging means 111. Air is blown into the membrane assembly 1052 by the fan 1082, and passes through the buffer tank 1062, vacuum pump 1042, condensation water tank 1072, oxygen-supplying pipe, enters into the automatic disengaging means 111, and finally is supplied for exercising people via the oxygen inhalator or oxygen mask. The micro membrane oxygen-enriched machine may use macromolecule osmosis membrane, so as to obtain an oxygen-enriched air with oxygen concentration of 25%-35%.

A flow control device may be installed on the oxygen inhalator so as to control the flow rate of the oxygen.

Embodiment 3

Figure 2A:
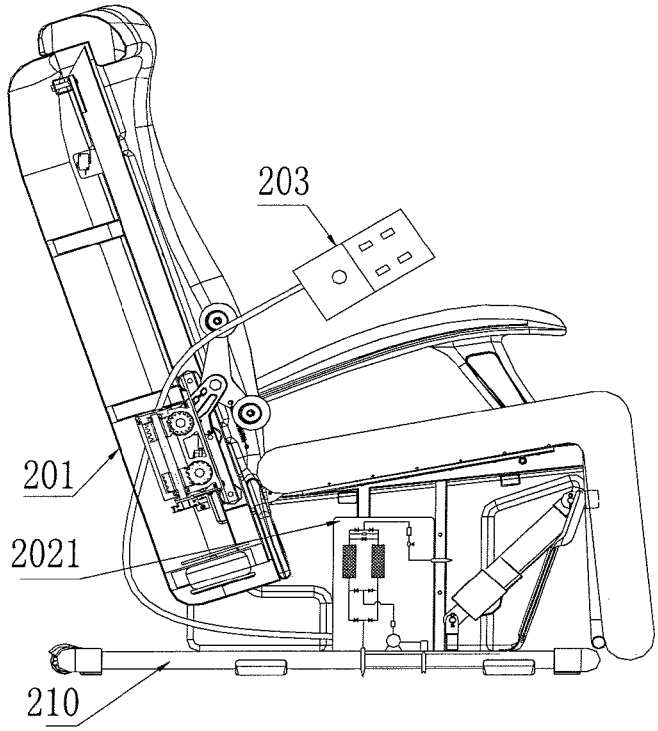
FIG. 2(*a*) is a schematic view showing the embodiment 3 of the leisure fitness equipment with oxygen-supplying function of the present invention, wherein the leisure fitness device is a massage sofa, the oxygenerator is a micro PSA oxygenerator.
Figure 2B:
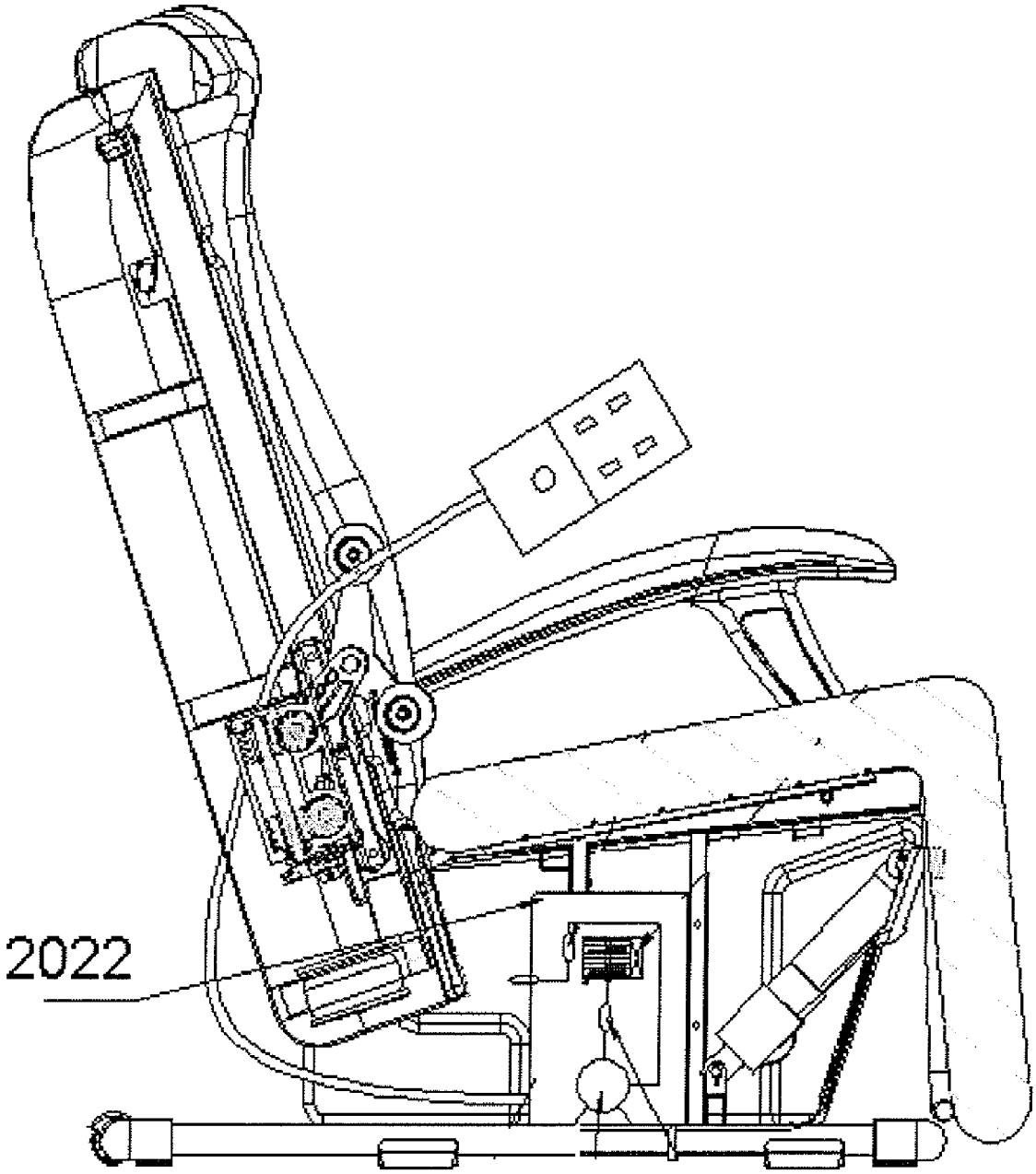

As shown in FIG. 2(*a*), the leisure fitness equipment with oxygen-supplying function comprises a massage sofa 201, an oxygenerator, a control device 203, an oxygen inhalator and an oxygen mask.

The oxygenerator is a micro PSA oxygenerator 2021, set on the base frame 210 of the massage sofa and integral with the massage sofa 201.

The control device 203 is a controller convenient for users to hold in hand, for controlling or setting the working state of the massage sofa 201 and oxygenerator 2021.

Embodiment 4

As shown in FIG. 2(*b*), the difference between the present embodiment and the embodiment 3 is that, the oxygenerator is a micro membrane oxygen-enriched machine 2022.

The micro-oxygenerator can be controlled separately from the leisure fitness device, with the control device inherently equipped with the micro-oxygenerator.

Figure 3:
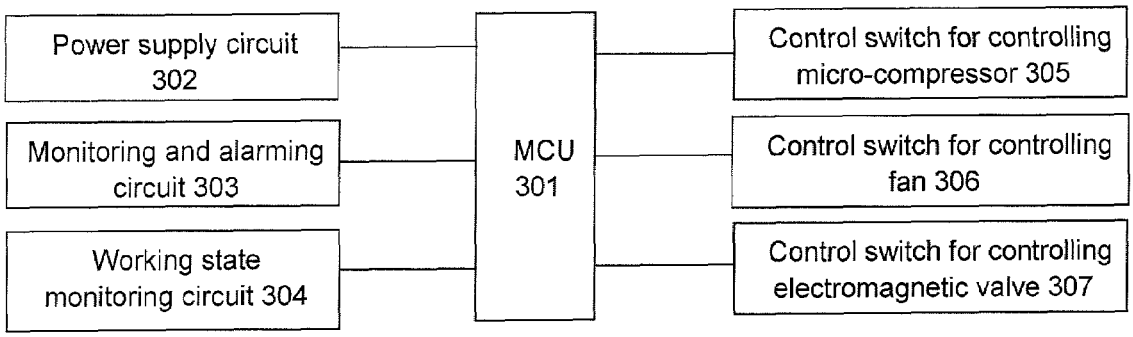
FIG. 3 is an electric diagram showing the control circuit for the micro oxygenerator of the leisure fitness equipment with oxygen-supplying function of the present invention.

As shown in FIG. 3, a control circuit board, installed inside the micro-oxygenerator of the leisure fitness equipment with oxygen-supplying function of the present invention, consists of a MCU (Micro Control Unit) chip 301, a power supply circuit 302, a monitoring and alarming circuit 303, a working state monitoring circuit 304 and control switches 305, 306, 307 for controlling the micro-compressor, the fan and the electromagnetic valve of the micro oxygenerator. Wherein MCU 301 is connected with the power supply circuit 302, the monitoring and alarming circuit 303, the working state monitoring circuit 304 and the control switches 305, 306, 307 respectively. Thereby, through the control switches 305, 306, 307, the micro-compressor, the fan and the electromagnetic valve are controlled by the MCU 301 respectively.

Figure 4:
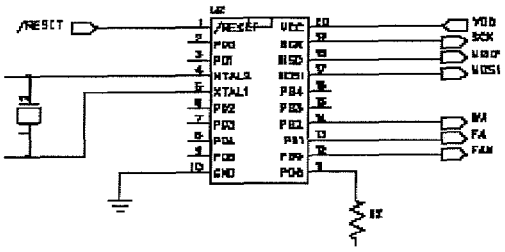
FIG. 4 is an electric connection diagram of the micro control unit of the control circuit shown in FIG. 3.

As shown in FIG. 4, MCU, the central controller of the whole equipment, controls the operation of every part of the whole equipment and also monitors various working states of the equipment.

Figure 5:
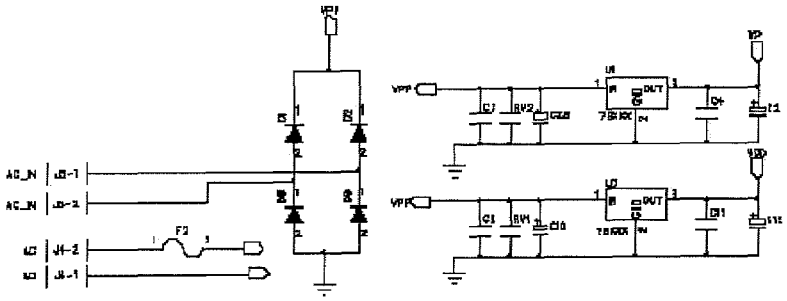
FIG. 5 is an electric connection diagram of the power supply circuit of the control circuit shown in FIG. 3.

As shown in FIG. 5, the desired DC voltages are obtained through a transformer and an AC/DC converter, and is further stabilized by a voltage regulating module. The VP and VDD outputs of the module are used as power supplies for different parts of the system: the VP is for the electromagnetic valve, the compressor and the fan, and the VDD is for various chips.

Figure 6:
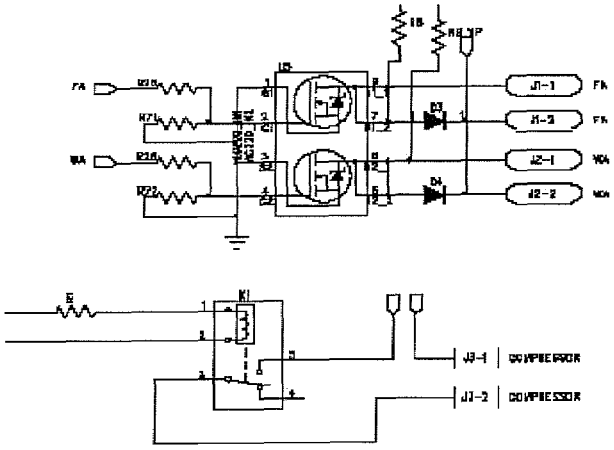
FIG. 6 is an electric connection diagram of the control switch circuit of the control circuit shown in FIG. 3.

As shown in FIG. 6, the control switch circuit has two parts, each comprising a MOS transistor and a relay system. One is used to control the electromagnetic valve and the other is for the operation of the compressor of the micro PSA oxygenerator. The control switch circuit works according to different control signals from the MCU, and thereby generates oxygen efficiently by way of PSA.

Alternatively, the micro-oxygenerator of the present invention can work under the control of the leisure fitness device.

Figure 7:
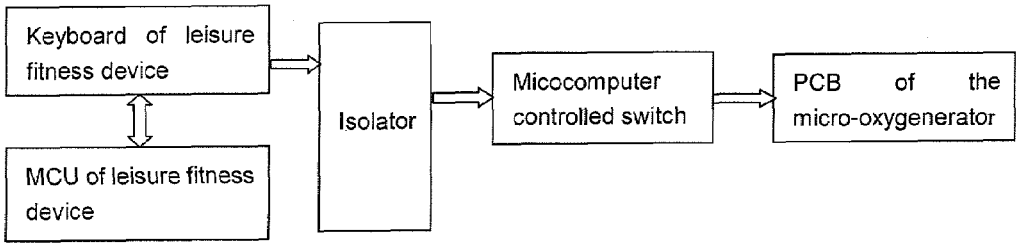
FIG. 7 is an electric diagram showing the control circuit of the leisure fitness equipment with oxygen-supplying function of the present invention, wherein the oxygenerator is under the control of the leisure fitness device.
Figure 8:
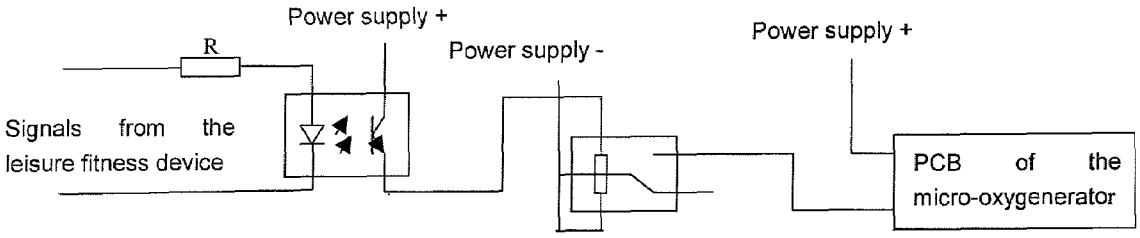
FIG. 8 is an electric connection diagram of the control circuit shown in FIG. 7.

As shown in FIG. 7, when the micro-oxygenerator works under the control of the leisure fitness device, the two parts are effectively isolated through a control interface which uses low-voltage signals to control relatively high-voltage part of the system. This technique helps avoid interferences between the micro-oxygenerator and the leisure fitness device. As shown in FIG.8, a current limiting resistor R is used to control the drive current of the photo coupler, and also keeps the current within the rated current of the port of the MCU of the leisure fitness device. An optoelectronic isolator EL817 is used to effectively isolate the signals between the leisure fitness device and the micro-oxygenerator, so that the possibility of interferences between each other is reduced to minimum. With the effect of the optoelectronic isolator, the electronic signals from the MCU drive the switch to work. The normally-on switch is connected with the PCB of the micro-oxygenerator, to control the working power supply of the micro-oxygenerator. In this way, the micro-oxygenerator can be effectively controlled by the controller of the leisure fitness device.

What is claimed is:

1. A leisure fitness equipment with oxygen-supplying function, comprising:

a leisure fitness device, an oxygenerator, which is fixed or detachably connected to said leisure fitness device, a control device, by which said leisure fitness device and said oxygenerator are controllable, an oxygen inhalator having two ends, one end of said oxygen inhalator is accessible for users, and an automatic disengaging means comprising a joint, a release spring and a positioning device;

wherein one end of the joint is connected to the oxygen inhalator, and the other end of the joint is set inside a base on the top of the leisure fitness device and presses against the release spring set inside the base; and wherein the joint is positioned inside the base via the positioning device and can be released from the base.

2. A leisure fitness equipment with oxygen-supplying function as claimed in claim 1, wherein, said leisure fitness device is any one kind of a massage sofa, a running machine, a fitness bicycle or a skiing machine.

3. A leisure fitness equipment with oxygen-supplying function as claimed in claim 1, wherein, said oxygenerator is fixed or detachably connected to the base frame of said leisure fitness device.

4. A leisure fitness equipment with oxygen-supplying function as claimed in claim 1, wherein, said oxygenerator is either a micro membrane oxygen-enriched machine or a micro PSA oxygenerator.

5. A leisure fitness equipment with oxygen-supplying function as claimed in claim 1, wherein, said control device is in the form of either a controller or a control panel.

6. A leisure fitness equipment with oxygen-supplying function as claimed in claim 1, wherein, a flow control device is installed on said oxygen inhalator.

7. A leisure fitness equipment with oxygen-supplying function as claimed in claim 1, wherein, the end of said oxygen inhalator, which is accessible for users, is connected with an oxygen mask.

8. A leisure fitness equipment with oxygen-supplying function as claimed in claim 1, wherein, said automatic disengaging means is set with a or tension limit, such that, once a user using said inhalator falls down, said automatic disengaging means will release and cause said oxygen inhalator to automatically release from the user.

* * * * *